US007900771B1

(12) United States Patent
Meng

(10) Patent No.: US 7,900,771 B1
(45) Date of Patent: Mar. 8, 2011

(54) TOOL BOX WITH PIVOTING ROW SOCKETS

(76) Inventor: Ji-Fen Meng, Taichung County (TW)

( * ) Notice: Subject to any disclaimer, the term of this patent is extended or adjusted under 35 U.S.C. 154(b) by 0 days.

(21) Appl. No.: 12/564,917

(22) Filed: Sep. 23, 2009

(51) Int. Cl.
*B65D 85/20* (2006.01)
*B65D 5/50* (2006.01)

(52) U.S. Cl. ..... 206/379; 206/372; 206/759

(58) Field of Classification Search ..... 206/372, 206/378–379, 759; 211/70.6
See application file for complete search history.

(56) References Cited

U.S. PATENT DOCUMENTS 5,570,784 A * 11/1996 Sidabras et al. ..... 206/378
6,988,616 B2 * 1/2006 Chen ..... 206/379
7,168,559 B2 * 1/2007 Chen ..... 206/373
7,699,176 B2 * 4/2010 Lin ..... 206/759

* cited by examiner

*Primary Examiner* — Bryon P Gehman

(57) ABSTRACT

A tool box structure includes a plurality of row sockets. Each row socket has a plurality of insert holes defined therein for adapting to receive a screwdriver bit and a positioning gutter formed at the bottom thereof. A box body is pivotally connecting to the row sockets. The box body has a plurality of positioning slots defined therein and corresponding to the quantity of the row sockets in the box body. An elastic element is installed between each positioning slot and each positioning gutter. The positioning slot and the positioning gutter is abutted by two ends of each elastic element. A cover body is installed to the box body. A plurality of openings is defined in the cover body and respectively corresponding to the insert holes in the row sockets.

5 Claims, 5 Drawing Sheets

TOOL BOX WITH PIVOTING ROW SOCKETS

BACKGROUND OF THE INVENTION

1. Field of the Invention

The present invention relates to a tool box structure, and more particularly to a tool box with a slidable cover.

2. Description of Related Art

A conventional toolbox structure includes a plurality of sockets formed in a box body having a cover, and provided for inserting a plurality of screwdriver bits, and each socket is pivotally formed at the box body and coupled with a link arm, and the front-most socket is pivotally installed to the box body and pivotally coupled with an extension arm of an upper cover, such that the aforementioned structure can be used for closing the upper cover without a tool, each socket will descend to be received into the box body. When the upper cover is opened, each socket rises automatically and protrudes out from the box body for users to access the screwdriver bit thereon.

Although this type of toolboxes can use the extension arm of the upper cover to drive the frontmost socket to be turned over with respect to the box body, and use the link arm to drive the rest of sockets in the box body to be turned over with respect to the box body, and the screwdriver bits inserted into the sockets are turned over slantingly outward to facilitate users to access the screwdriver bits. However, such conventional toolbox requires a large number of components installed and linked with each other before the upper cover can be lifted while displaying the screwdriver bits and facilitating users to access the screwdriver bits. Obviously, the structure of the conventional toolbox is too complicated and unfavorable for the installation.

Furthermore, the sockets are linked with each other by a link arm, and its movement relies on the link arm installed onto the upper cover to drive the sockets to be turned over, and the sockets are driven directly or indirectly by the link arm to turn over other sockets. If the socket or the link arm is not operated with a correct alignment, then the sockets cannot be turned over outwardly when the upper cover is lifted, or the link arm may get stuck and cannot be turned, or may even fall off.

Since the present existing automatic displaying toolbox structure is too complicated and unfavorable for the installation, and it is difficult to assure the correct alignment or a proper link of the components in a practical application, therefore such displaying toolbox cannot maximize its utility. Obviously, the conventional toolbox structure requires improvements.

SUMMARY OF THE INVENTION

The main objective of the present invention is to provide an improved tool box structure.

To achieve the foregoing objective, the present invention provides a toolbox structure comprising:

a plurality of row sockets, each having a plurality of insert holes, for inserting a screwdriver bit, and a positioning gutter formed at the bottom of each row socket;

a box body, for pivotally connecting the row sockets, and having a plurality of positioning slots corresponding to the quantity of the row sockets in the box body, and each positioning slot being disposed opposite to a positioning gutter of each row socket, and an elastic element being installed between each positioning slot and each positioning gutter, and the positioning slot and the positioning gutter being abutted by both ends of each elastic element;

a cover body, installed to the box body, such that the cover body and the box body are slidable with respect to each other, and having a pressing surface formed on an internal wall at a top surface of the cover body and corresponding to the position of the row socket, and a plurality of openings formed at positions corresponding to the positions of the row sockets respectively with a quantity corresponding to the insert holes;

thereby, if the cover body is closed, each pressing surface will be in contact with the corresponding row socket, and the elastic element will be abutted and compressed by the row socket, and the screwdriver bit inserted into each row socket will be contained in the box body; and if the cover body is slid open, each pressing surface will be withdrawn from the corresponding row socket, and the elastic element will be released from compressing and abutting the row socket to swing pivotally upward, and the screwdriver bit inserted into each row socket will swing pivotally with the row socket from the top of the cover body and protruded from an opening at the top of the cover body.

DETAILED DESCRIPTION OF THE INVENTION

The structure, assembly, technical characteristics and effects of the present invention will become apparent with the detailed description of preferred embodiment together with related drawings as follows:

With reference to FIGS. 1 to 5 for a toolbox structure in accordance with a preferred embodiment of the present invention, a toolbox used for storing screwdriver bits is used for the illustration of the present invention.

Figures 1, 1A:
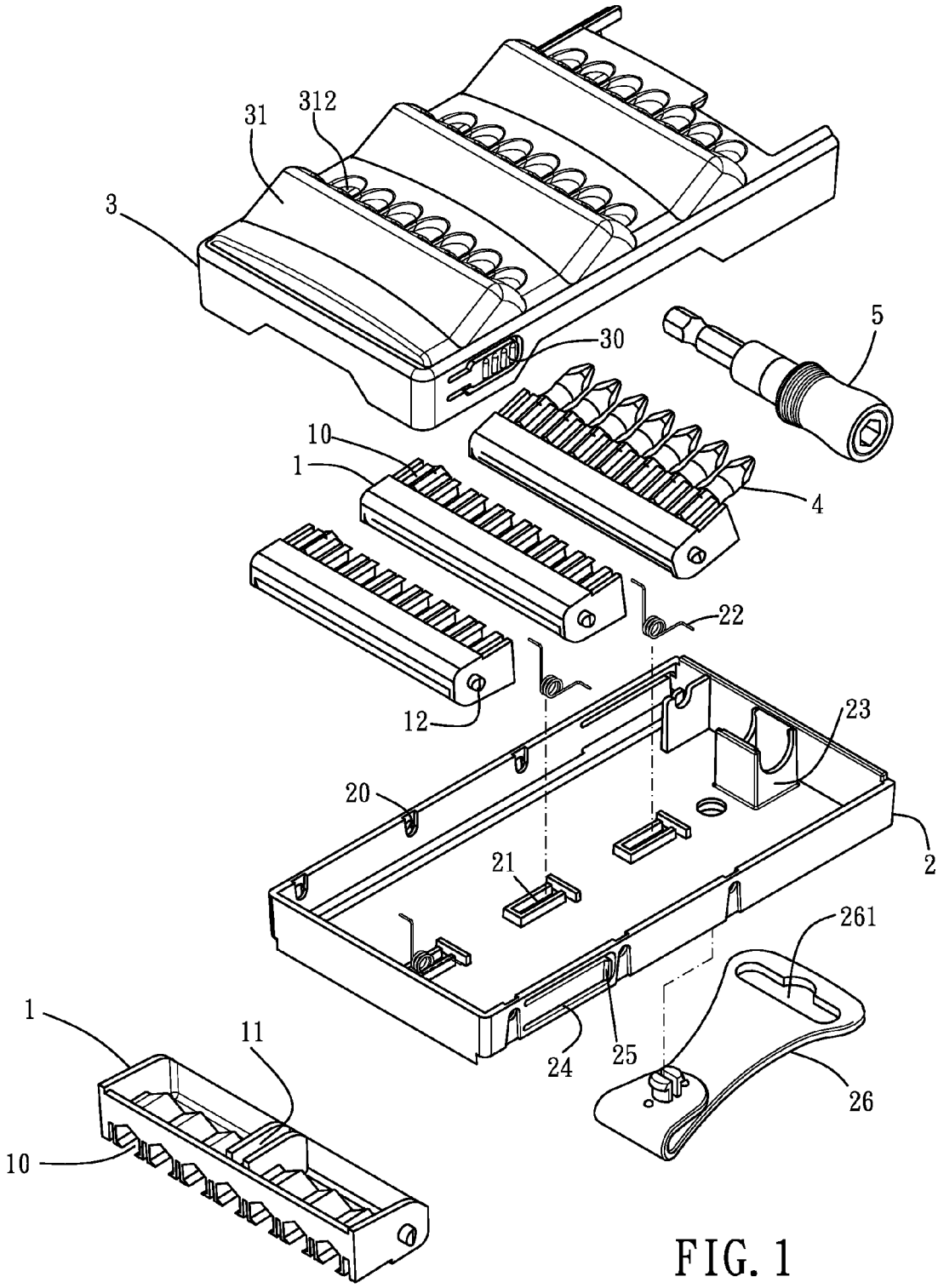
FIG. 1 is an exploded view of a toolbox structure in accordance with the present invention.
FIG. 1A is an exploded view of row socket in another direction.
Figure 2:
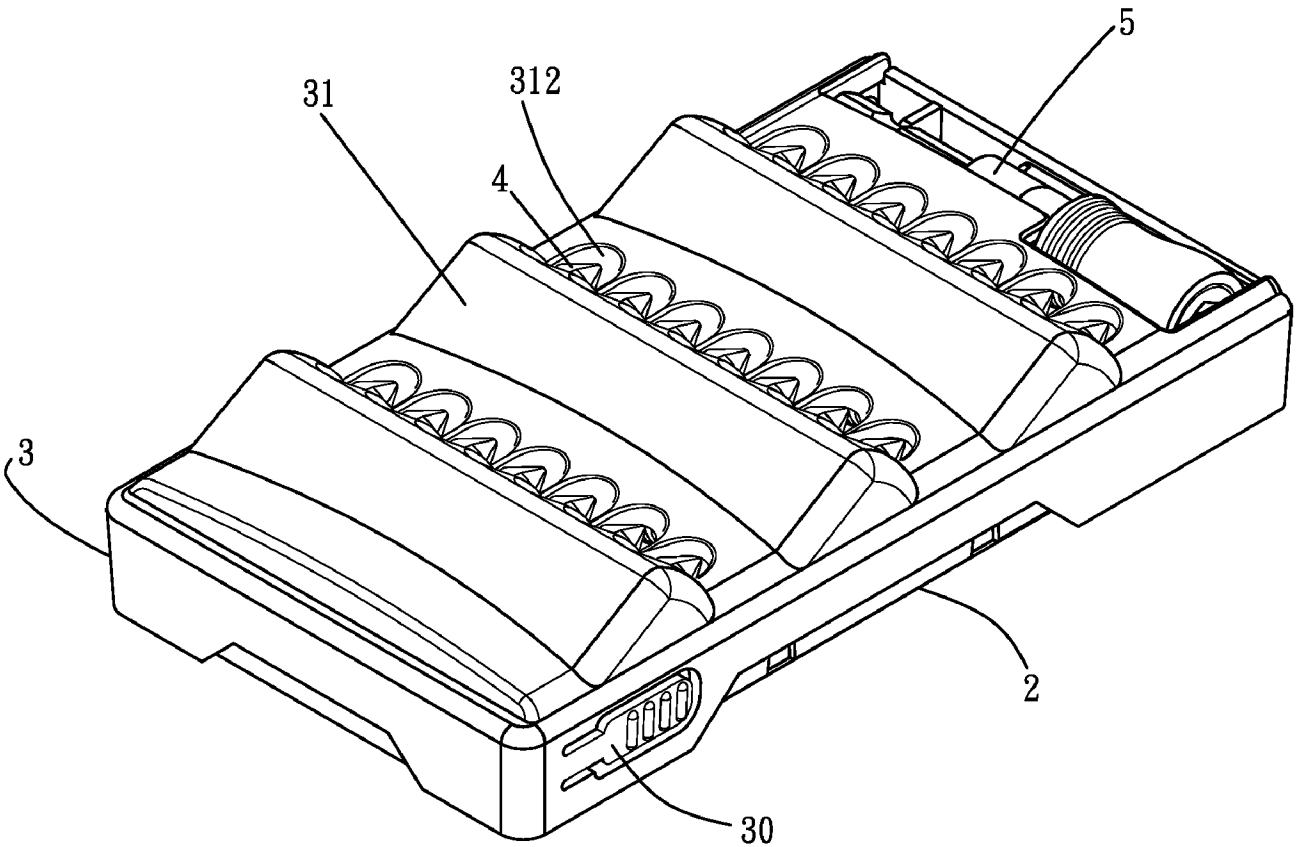
FIG. 2 is a perspective view of a closed cover body in accordance with the present invention.

In FIGS. 1 and 2 (wherein FIG. 1A is a bottom view of a row socket 1), the toolbox structure comprises:

three transversal row sockets 1, each having a plurality of insert holes 10 disposed at the top of the row sockets 1, and each insert hole being provided for inserting a screwdriver bit 4, and each row socket 1 having a positioning gutter 11 formed at the bottom of the row socket 1, and a lug 12 disposed on each of left and right ends of the row socket 1;

a box body 2, including a plurality of embedding holes 20 disposed on each of two longer sidewalls of the box body 2 and with a quantity corresponding to the quantity of the row sockets 1, for embedding each row socket 1 into the box body 2 by correspondingly engaging the embedding holes with the lugs 12 and transversally and pivotally coupled into the box body 2, and a plurality of positioning slots 21 formed in the box body 2 and with a quantity corresponding to the quantity of the row sockets 1, and each positioning slot 21 located correspondingly to the positioning gutter 11 of each row socket 1, and having an elastic element 22 compressibly installed between each positioning slot 21 and its corresponding positioning gutter 11, wherein two ends of the elastic element 22, which is a torque spring in this preferred embodiment, are installed to abut against the corresponding positioning slot 21 and positioning gutter 11 respectively, and the box body 2 further includes a rod holder 23 for receiving a driver rod 5 used for installing and connecting a screwdriver bit 4, and a slide rail 24 is disposed between two of the embedding holes 20 on each of the two longer sidewalls, and a latch 25 is formed on and protruded from an end of each slide rail 24, and a clip 26 is installed at the bottom of the box body 2 for clipping a belt, and a hanging opening 261 is formed at an end of the clip 26 for hanging of the box body 2;

a cover body 3, having an elastic arm 30 installed on each of two longer sidewalls of the cover body 3, and movably engaged to the corresponding slide rail 24 and the adjacent latch 25 of the box body 2 respectively, and moved on the corresponding slide rail 24 and slid with respect to the box body 2 by the elastic arm 30, and latched with the corresponding latch 25 and fixed with the box body 2 by the elastic arm 30, and three aslant protruding surface 31 being formed at a top side of the cover body 3 and extended to a position corresponding to the three row sockets 1, and both ends of each aslant protruding surface 31 being extended from a lower part to an upper part, and the cover body 3 having three pressing surfaces 311 disposed thereon, and each pressing surface 311 located at an internal wall of the corresponding aslant protruding surface 31 and being adjacent to the lower part of the corresponding aslant protruding surface 31 for selectively pressing the corresponding row socket 1, and a plurality of opening 312 defined in the cover body 3 and being adjacent to the lower parts of the aslant protruding surfaces 31 for corresponding to the insert holes 10, such that a screwdriver bit 4 is able to protrude out from the corresponding opening 312.

With the foregoing structure, the present invention pivotally installs the row sockets 1 into the box body 2, and provides an elastic element 22 installed between each row socket 1 and the box body 2 and having a pivotal force for clipping the corresponding row socket 1, and also latches the cover body 3 onto box body 2 to form a containing space for accommodating the screwdriver bits 4 and the driver rod 5.

Figure 3:
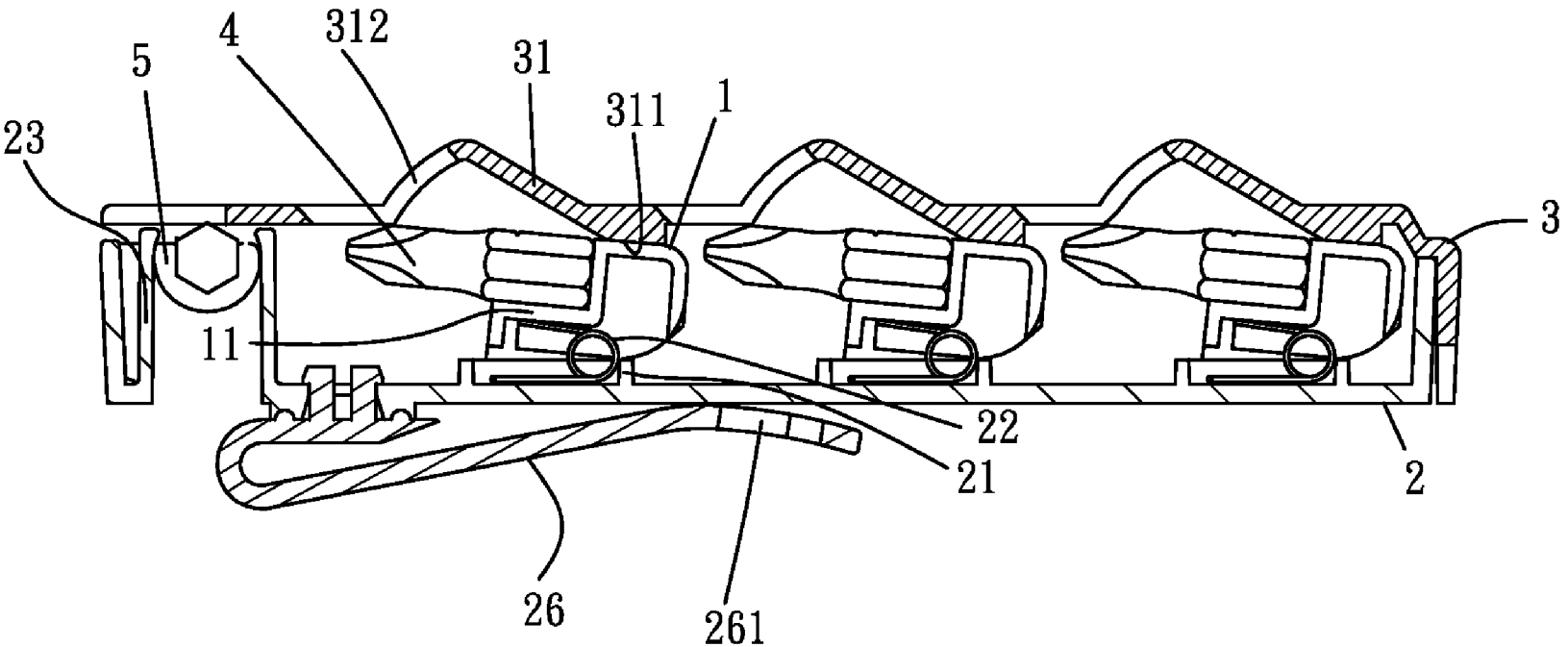
FIG. 3 is a cutaway side view of a closed cover body in accordance with the present invention.
Figure 4:
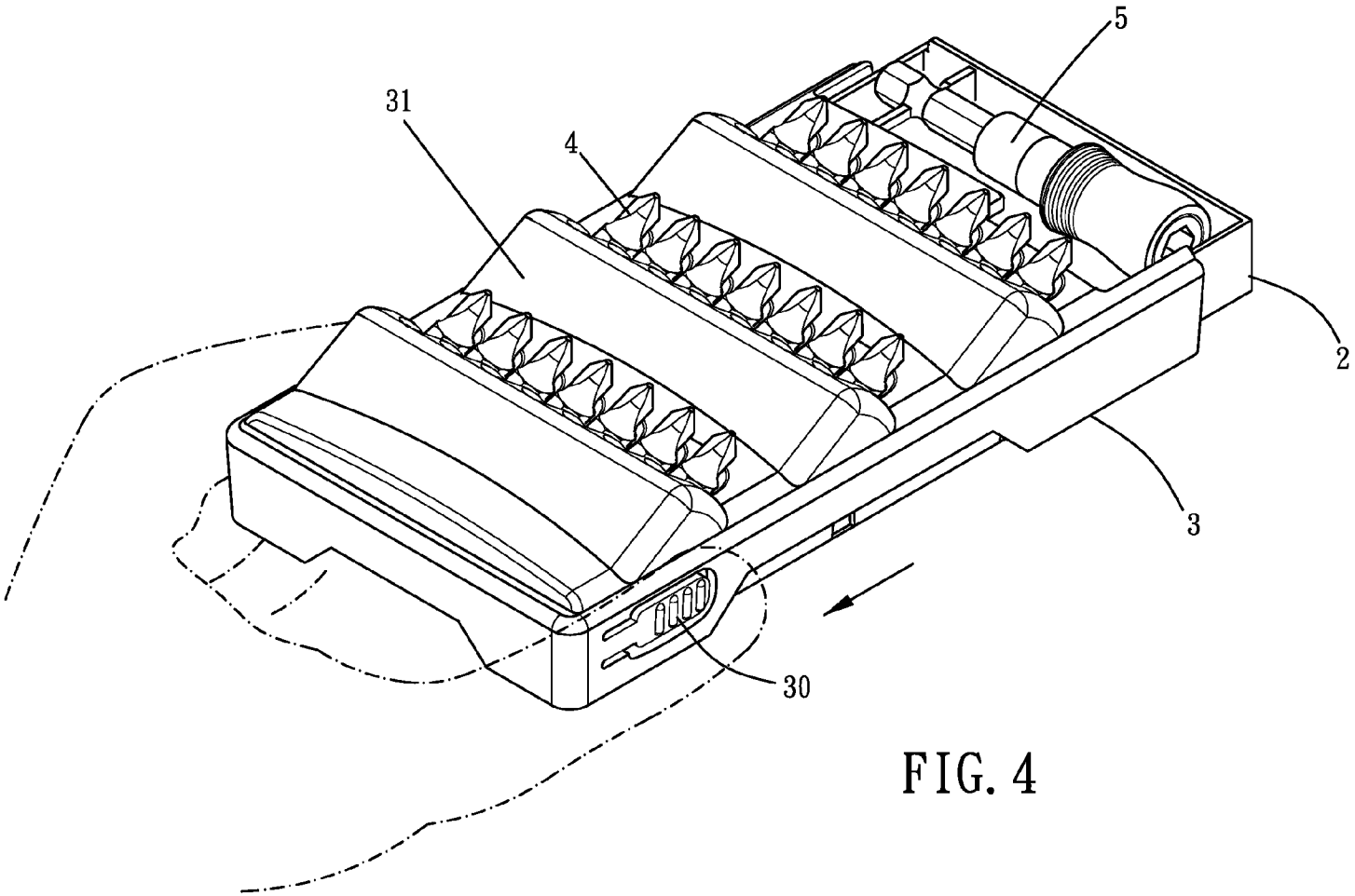
FIG. 4 is a schematic view of a sliding cover body in accordance with the present invention.
Figure 5:
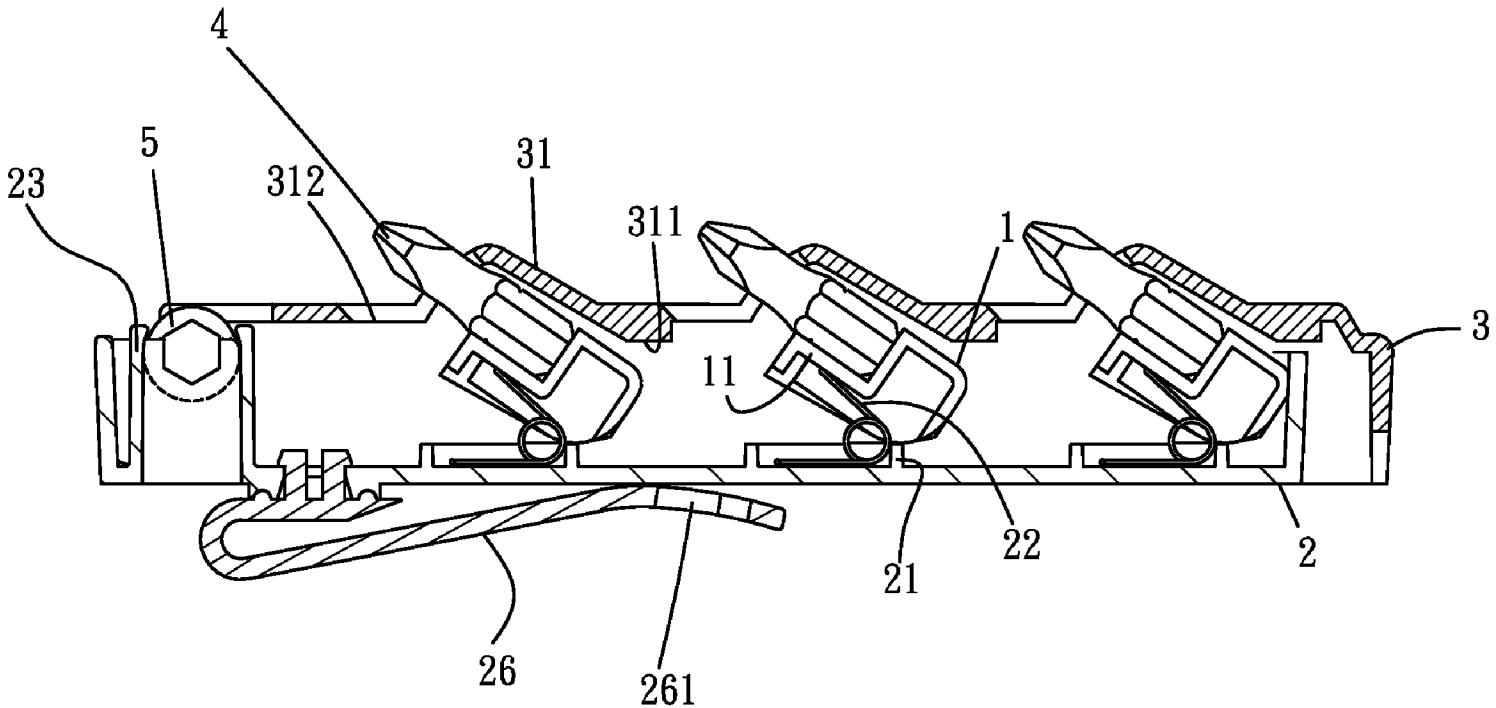
FIG. 5 shows a vertical section of a sliding box cover in accordance with the present invention.

With reference to FIGS. 3 to 5, if the cover body 3 is closed (as shown in FIG. 2), then each pressing surface 311 will be in contact with the corresponding row socket 1, and each row socket 1 is inverted in the box body 2 under the pressing of the pressing surface 311, and each elastic element 22 is abutted by the positioning gutter 11 at the bottom of the corresponding row socket 1 to store a force for pivotally swing the corresponding row socket 1 upward, and each screwdriver bit 4 inserted into the corresponding insert hole 10 will lie horizontally in the box body 2 (as shown in FIG. 3).

If the cover body 3 is slid open (as shown in FIG. 4), then each pressing surface 311 will withdraw from the corresponding row socket 1, and each row socket 1 will not be pressed by the corresponding pressing surface 311 anymore, while the pressing of each elastic element 22 is being released, such that each elastic element 22 is changed from a compressed state to a release state to release the force and push the corresponding row socket 1 to pivotally swing upward, and each row socket 1 is abutted and lifted inside the box body 2, and the screwdriver bits 4 inserted into each row socket 1 will be pivotally swung and lifted together with the corresponding row socket 1 and respectively protruded out from the corresponding openings 312 at the top surface of the cover body 3 (as shown in FIG. 5), so as to achieve the effect of a display and a quick access of the screwdriver bits 4. Since the screwdriver bits 4 are stopped by the aslant protruding surfaces 31, they can be prevented from being separated improperly from the row sockets 1 in the box body 2 due to an instant pushing force of the released elastic elements 22.

In summation of the description above, the present invention has the following advantages:

In addition to the basic components including the box body 2, the cover body 3 and the row sockets 1 of the toolbox, the overall structure simply needs to install an additional elastic element 22 between each row socket 1 and the box body 2, such that the design of using the elastic element 22 clipped between the corresponding row socket 1 and the box body 2 to operate with the closing or sliding open the cover body 3, a force for compressing each row socket 1 onto the corresponding elastic element 22 or a force for pivotally swinging each row socket 1 by the corresponding elastic element 22 can be controlled to achieve the effect of displaying or storing the screwdriver bits to facilitate a quick access of the screwdriver bits. The invention not just comes with simple components for an easy assembling only, but also maximizing the effect of automatically displaying the screwdriver bits effectively while the toolbox is being opened, due to the smooth alignment and link of the components.

In addition, the present invention uses the clip 26 for clipping a belt and latching a user's waist, such that if the cover body 3 is slid downward, the screwdriver bits will be respectively protruded out from the openings 312 of the cover body 3 for providing a quick access of the screwdriver bits. If the cover body 3 is pushed back, then each pressing surface 311 on the internal wall at the front end of the corresponding aslant protruding surface 31 will be in contact with the corresponding row socket 1 to resume its inverted status and draw back the screwdriver bits. The present invention provides a convenient way of displaying and storing the screwdriver bits.

Although the invention has been explained in relation to its preferred embodiment, it is to be understood that many other possible modifications and variations can be made without departing from the spirit and scope of the invention as hereinafter claimed.

What is claimed is:

1. A tool box structure comprising:

a plurality of row sockets, each row socket having a plurality of insert holes defined therein for adapting to receive a plurality of screwdriver bits and a positioning gutter formed at the bottom of each row socket;

a box body pivotally connecting to the row sockets, the box body having a plurality of positioning slots defined therein and corresponding to the quantity of the row sockets in the box body, each positioning slot located correspondingly to the positioning gutter of a respective row socket, a respective elastic element compressibly installed between each positioning slot and its corresponding positioning gutter, the corresponding positioning slot and positioning gutter abutted by two ends of each elastic element;

a cover body installed to the box body, the cover body and the box body being slidable with respect to each other, the cover body having a plurality of pressing surfaces formed on an interior thereof and each pressing surface corresponding to one of the row sockets, a plurality of openings defined in the cover body and respectively corresponding to the insert holes in the row sockets;

wherein, when the cover body is closed, each pressing surface contacts with its corresponding row socket, each elastic element is compressed by its corresponding row socket, the screwdriver bits retained in the insert holes of the row sockets; and when the cover body is slidingly opened, each pressing surface is detached from the corresponding row socket, the corresponding elastic element is released from compressing and abutting the corresponding row socket to pivot upwardly, the screwdriver bits inserted into each respective row socket pivoted upwardly with the corresponding row socket from the top of the cover body and protruded from the corresponding openings at the top of the cover body, for achieving the effect of displaying and accessing the screwdriver bits quickly.

2. The toolbox structure as claimed in claim 1, wherein the cover body has a plurality of aslant protruding surfaces disposed at the top of the cover body and respectively corresponding to the plurality of row sockets, each aslant protruding surface divided into an upper part and a lower part, each pressing surface being adjacent to an interior of the lower part of each aslant protruding surface of the cover body, each opening being adjacent to the upper part of each aslant protruding surface.

3. The toolbox structure as claimed in claim 1, wherein the box body has a driver rod accommodated in a rod holder and used for installing a screwdriver bit, a plurality of embedding holes formed on two sidewalls of the box body and corresponding to the row sockets, each row socket having a respective lug disposed on each end of the row socket, and each lug corresponding to a respective embedding hole, each lug embedded into its corresponding embedding hole and pivotally disposed into the box body.

4. The toolbox structure as claimed in claim 1 further comprising a slide rail disposed on each of two sidewalls of the box body respectively, a latch formed on one end of each slide rail, an elastic arm installed on each of two sidewalls of the cover body and movably engaged to the corresponding slide rail and the adjacent latch respectively;

wherein when each elastic arm is moved in the corresponding slide rail and slid with respect to the box body, the elastic arm is latched with the corresponding latch and fixed with the box body.

5. The toolbox structure as claimed in claim 1, wherein the box body has a clip disposed thereon, the clip having a hanging opening formed at an end of the clip for providing hanging of the box body.

* * * * *